US012509979B2

(12) United States Patent
Almulhim et al.

(10) Patent No.: US 12,509,979 B2
(45) Date of Patent: Dec. 30, 2025

(54) PLACING WELLS IN A SUBSURFACE FORMATION

(71) Applicant: Saudi Arabian Oil Company, Dhahran (SA)

(72) Inventors: Abdulrahman Almulhim, Dhahran (SA); Babatunde Moriwawon, Al Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/743,972

(22) Filed: Jun. 14, 2024

(65) Prior Publication Data

US 2025/0382864 A1 Dec. 18, 2025

(51) Int. Cl.
*E21B 43/30* (2006.01)
*E21B 44/00* (2006.01)

(52) U.S. Cl.
CPC ..... *E21B 43/30* (2013.01); *E21B 44/00* (2013.01); *E21B 2200/20* (2020.05)

(58) Field of Classification Search
CPC ..... E21B 44/00; E21B 43/30; E21B 2200/20
See application file for complete search history.

(56) References Cited

U.S. PATENT DOCUMENTS

2006/0241867 A1* 10/2006 Kuchuk ..... G01V 11/00 324/303
2016/0047206 A1* 2/2016 Vempati ..... G06F 30/23 703/7
2021/0350052 A1* 11/2021 AlQahtani ..... G06F 3/0482

OTHER PUBLICATIONS

Levchenko et al., "Simulation-Based Methodology for Optimization of Infill Well Locations in a Mature Oilfield," SPE-217506-MS, paper presented at the SPE Caspian Technical Conference and Exhibition, Baku, Azerbaijan, Nov. 21-23, 2023, 8 pages.
Tavallali et al., "Optimal producer well placement and production planning in an oil reservoir," Computers & Chemical Engineering, Aug. 8, 2013, 55, 109-125, 17 pages.

* cited by examiner

*Primary Examiner* — Dany E Akakpo
(74) *Attorney, Agent, or Firm* — Fish & Richardson P.C.

(57) ABSTRACT

Systems and methods for placing a well in a subsurface formation include obtaining reservoir properties from the subsurface formation; determining an area of interest based on the reservoir properties and a free water level or an oil-water contact in the subsurface formation; determining sweet spot areas in the area of interest based on the reservoir properties; identifying a location to place a well in the subsurface formation by performing a clustering analysis based on the sweet spot areas; and determining a well path for the well based on the reservoir properties and the free water level or the oil-water contact.

17 Claims, 8 Drawing Sheets

PLACING WELLS IN A SUBSURFACE FORMATION

TECHNICAL FIELD

This disclosure relates to placing wells in subsurface formations.

BACKGROUND

Wells are drilled into subsurface formations to access hydrocarbons stored in reservoirs within the subsurface formation. Wells can extend vertically, horizontally, or slanted into the subsurface formation. Properties of the subsurface formation (e.g., geological, geophysical, petrophysical properties) affect the placement of the wells and the ability to produce hydrocarbons to the surface through the wells.

SUMMARY

Some wells are placed in areas of a subsurface formation near a free water level (FWL) or oil-water contact (OWC) depth. Such wells can begin producing high amounts of water shortly after beginning production of hydrocarbons from the well due to the proximity of the FWL or OWC. Delaying the production of water from the well can increase the cumulative amount of hydrocarbons that can be produced from the well.

This disclosure provides an approach for placing wells in a subsurface formation at locations that can delay or reduce production of water. This approach can obtain reservoir properties from the subsurface formation. An area of interest in the subsurface formation can be determined based on the reservoir properties and a free water level or oil-water contact depth. Sweet spot areas in the area of interest can be determined based on the reservoir properties. A location to place a well in the subsurface formation can be determined by performing a clustering analysis based on the sweet spot areas. A well path can be determined based on the reservoir properties and the free water level or the oil-water contact depth. The well can be drilled in the subsurface formation at the identified location based on the determined well path.

Implementations of the systems and methods of this disclosure can provide various technical benefits. Using a clustering analysis to determine the well placement selects locations that have high cumulative hydrocarbon volumes and reduces the likelihood of interference between nearby wells in the subsurface formation. Determining the well path for the well based on the vertical permeability from the FWL to the completion level of the well can decrease the overall water cut produced by the well and increase the cumulative oil production from the well. This approach can be applied to thin reservoirs that include a lateral section close to the FWL or OWC to reduce the overall water cut and increase the cumulative oil production. By reducing the overall water cut, the well can produce hydrocarbons more efficiently. Placing wells based on this approach can also delay water breakthrough during the production phase of the well.

The details of one or more implementations of these systems and methods are set forth in the accompanying drawings and the description below. Other features, objects, and advantages of these systems and methods will be apparent from the description and drawings, and from the claims.

DESCRIPTION OF DRAWINGS

Like reference symbols in the various drawings indicate like elements.

DETAILED DESCRIPTION

Some wells are placed in areas of a subsurface formation near a FWL or OWC depth. Such wells can begin producing high amounts of water shortly after beginning production of hydrocarbons from the well due to the proximity of the FWL or OWC. Delaying the production of water from the well can increase the cumulative amount of hydrocarbons that can be produced from the well.

This disclosure provides an approach for placing wells in a subsurface formation at locations that can delay or reduce production of water. This approach can obtain reservoir properties from the subsurface formation. An area of interest in the subsurface formation can be determined based on the reservoir properties and a free water level or oil-water contact depth. Sweet spot areas in the area of interest can be determined based on the reservoir properties. A location to place a well in the subsurface formation can be determined by performing a clustering analysis based on the sweet spot areas. A well path can be determined based on the reservoir properties and the free water level or the oil-water contact depth. The well can be drilled in the subsurface formation at the identified location based on the determined well path.

Figure 1:
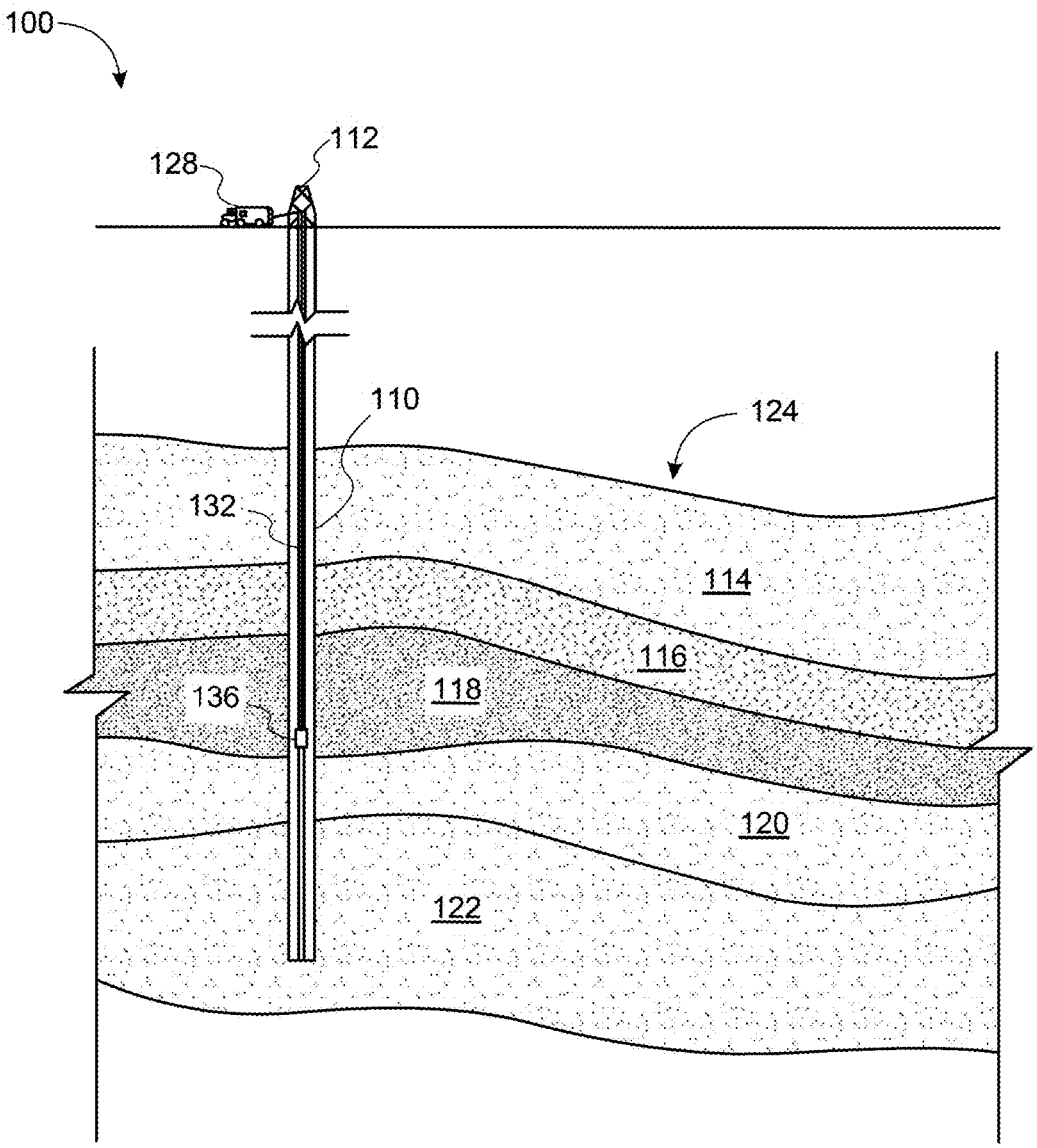
FIG. 1 is a schematic illustrating a subsurface formation.

FIG. 1 illustrates a wireline operation 100 (e.g., a well logging operation) in which a wellbore 110 extends downhole from a wellhead 112. The wireline operation 100 can be performed to measure properties of a subsurface formation 124. Example properties include oil saturation, rock porosity, and vertical permeability that can be used for determining a well path for a well.

The wellbore 110 is a vertical wellbore but wireline operations can also be performed in other wellbores, for example, slanted or horizontal wellbores. In the wireline operation 100, the wellbore 110 penetrates through five layers 114, 116, 118, 120, 122 of the subsurface formation 124. A control truck 128 lowers a logging tool 132 (e.g., a porosity logging tool) down the wellbore 110 on a wireline 136.

The logging tool 132 is string of one or more instruments with sensors operable to measure petrophysical properties of the subsurface formation 124. For example, logging tools can include resistivity logs, borehole image logs, porosity logs, density logs, or sonic logs. Resistivity logs measure the subsurface electrical resistivity, which is the ability to impede the flow of electric current. These logs can help differentiate between formations filled with salty waters (good conductors of electricity) and those filled with hydrocarbons (poor conductors of electricity). Porosity logs measure the fraction or percentage of pore volume in a volume of rock using acoustic or nuclear technology. Acoustic logs measure characteristics of sound waves propagated through the well-bore environment. Nuclear logs utilize nuclear reactions that take place in the downhole logging instrument or in the formation. Density logs measure the bulk density of a formation by bombarding it with a radioactive source and measuring the resulting gamma ray count after the effects of Compton scattering and photoelectric absorption. Sonic logs provide a formation interval transit time, which typically a function of lithology and rock texture but particularly porosity. The logging tool includes a piezoelectric transmitter and receiver and the time taken for the sound wave to travel the fixed distance between the two is recorded as an interval transit time.

As the logging tool 132 travels downhole, measurements of formations properties are recorded to generate a well log. In the illustrated operation, the data are recorded at the control truck 128 in real-time. Real-time data are recorded directly against measured cable depth. In some well-logging operations, the data is recorded at the logging tool 132 and downloaded later. In this approach, the downhole data and depth data are both recorded against time The two data sets are then merged using the common time base to create an instrument response versus depth log.

In the wireline operation 100, the well logging is performed on a wellbore 110 that has already been drilled. In some operations, well logging is performed in the form of logging while drilling techniques. In these techniques, the sensors are integrated into the drill string and the measurements are made in real-time, during drilled rather using sensors lowered into a well after drilling.

Using a wireline coring tool, core samples can be obtained in addition to obtaining well logs. A core sample is a usually cylindrical piece of the subsurface formation that is removed by a special drill and brought to the surface. Core samples can be used to measure petrophysical properties of the subsurface formation such as grain size, porosity, permeability, and unconformity. Core samples can be taken from the sidewalls of a drilled well. When sidewall core samples are repeated along the length of the well, the properties measured from the core samples can be compared and correlated with well logging measurements.

Figure 2:
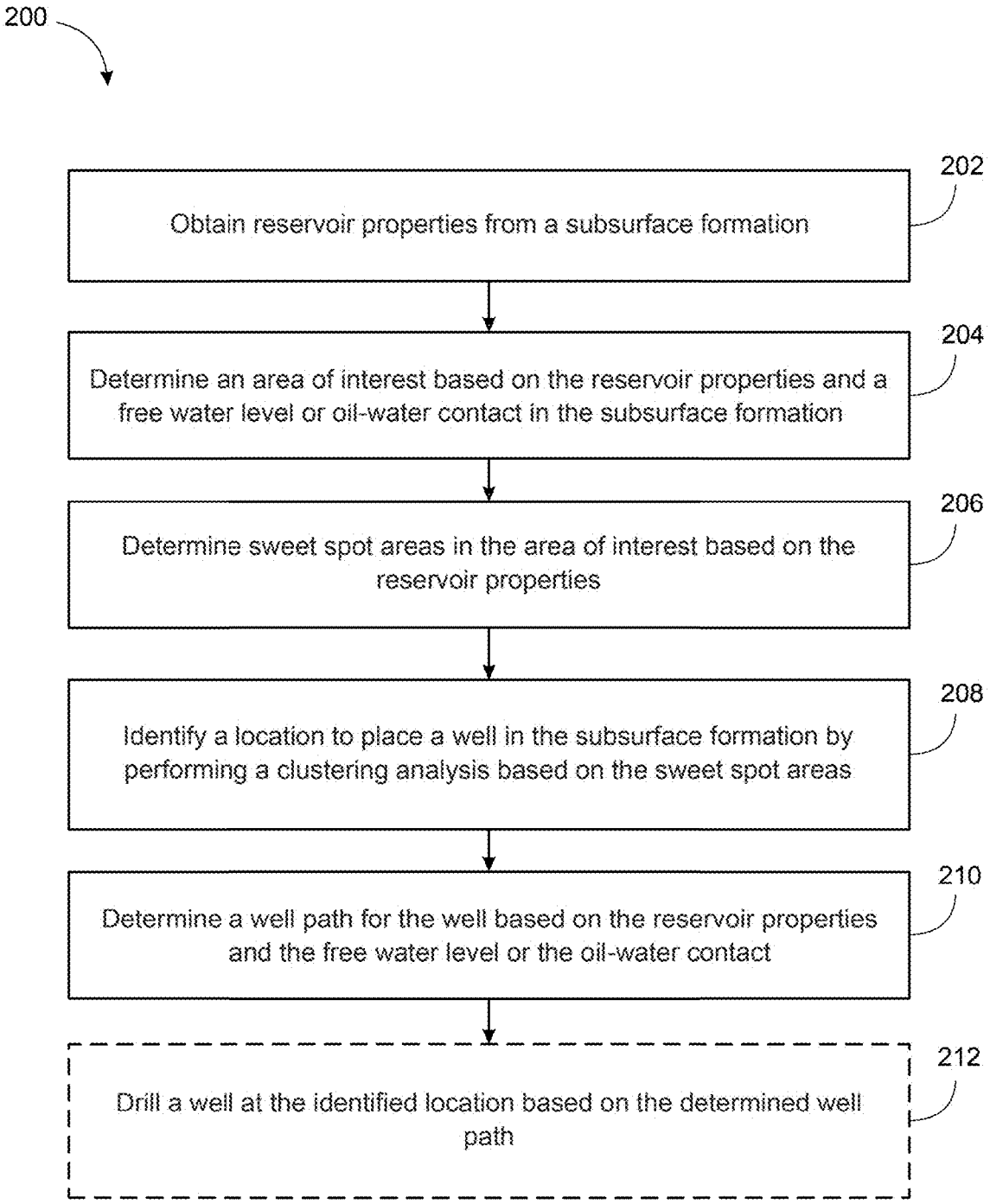
FIG. 2 is a flow chart for a method of placing a well.

FIG. 2 is a flow chart for an example method 200 for placing a well in a subsurface formation. The method 200 can be implemented on a data processing system such as a computer or control system (e.g., the computer system of FIG. 10).

The data processing system obtains reservoir properties from the subsurface formation (step 202). For example, the data processing system can obtain the reservoir properties by controlling a wireline operation (e.g., wireline operation 100). In some implementations, the data processing system obtains reservoir properties that have been previously collected and stored (e.g., in a data store). Reservoir properties can include FWL, OWC, rock porosity, vertical permeability, oil saturation, water saturation etc.

The data processing system determines an area of interest (AOI) based on the reservoir properties and an FWL or OWC of the subsurface formation (step 204). The AOI can be determined based on a desired oil saturation at the area of interest $S_{oil\text{-}AOI}$, an oil saturation at the top of an oil column, $S_{oil\text{-}crest}$, a height above the FWL or OWC for the AOI, $h_{AOI\text{-}FWL}$, and the total height of the oil column, $h_{total\text{-}FWL}$:

$$S_{oil\text{-}AOI} = S_{oil\text{-}crest} * \frac{h_{AOI-FWL}}{h_{total-FWL}}$$

The oil saturation at the AOI can be, for example, 20% or less. The oil saturation at the AOI can be based on the reservoir thickness and/or other geological, geophysical, and petrophysical properties. In some implementations, the desired oil saturation at the AOI can be obtained from a user (e.g., as a user input). In some implementations, the oil saturation at the height of the oil column can be 100% saturation.

In some implementations, such as thin reservoirs (e.g., 10 foot (3 meter) reservoir thickness), $S_{oil\text{-}AOI}$=20%, results in a very narrow band for the AOI (e.g., 2 feet (0.61 meter)). In such cases, the AOI can be adjusted to include a larger percentage of the reservoir thickness (e.g., 50% of the thickness).

The data processing system determines sweet spot areas in the AOI based on the reservoir properties (step 206) Sweet spot areas include, for example, areas in the reservoir with high oil saturation and/or high volumes of hydrocarbons relative to other areas in the subsurface formation. Sweet spot areas can be determined, for example, based on the oil saturation, $S_o$, of the subsurface formation and the rock porosity, $\phi$, e.g., SWEETSPOT=$S_o$*$\phi$. A desired SWEETSPOT can have a value, for example, between 20 and 30 percent. The desired SWEETSPOT value can be in other ranges also depending on the reservoir properties and other factors. Other methods for determining the sweet spot areas can also be used.

The data processing system identifies a location to place a well in the subsurface formation by performing a clustering analysis based on the sweet spot areas (step 208). Performing the clustering analysis can include applying a density-based clustering method (e.g., DBSCAN) to generate clusters that have a high density of the sweet spot areas separated by regions having a low density of the sweet spot areas. Density-based clustering methods can automatically segregate and cluster data points into an arbitrary number of clusters based on the density of the data points without specifying the number of clusters beforehand. In some implementations, other clustering methods, e.g., k-means or hierarchical clustering, can be used when a specific number of clusters are desired. The use of a clustering method is advantageous to visualize, understand and select effective sweet spot areas, for example, sweet spot areas that have the highest hydrocarbon volume associated with the sweet spots as compared to other sweet spots. The inputs to the clustering analysis include identified sweet spot areas including large and small areas. The outputs of the clustering analysis include effective sweet spot areas in which small areas are aggregated with close by larger areas.

The data processing system can determine the location to place the well by selecting a cluster that includes the sweet spot areas having a largest hydrocarbon volume as compared to the sweet spot areas in other clusters. In some implementations, a minimum distance between the well being placed and other wells in the subsurface formation can be used as a constraint when determining the location. This minimum distance between wells constraint can reduce interference between neighboring wells thereby increasing the production efficiency of the wells.

The data processing system determines a well path for the well based on the reservoir properties and the FWL or OWC (step 210). For example, the data processing system can determine the well path based on a vertical permeability ($k_z$) of the subsurface formation between the FWL/OWC and a completion section of a well. In some implementations, the data processing system generates multiple well paths. The data processing system can determine a hydrocarbon production potential and a water cut for each well path of the multiple well paths. The data processing system can select the well path from the multiple well paths based on a highest hydrocarbon production potential and a lowest overall water cut. For example, the selected well path is associated with the highest cumulative oil production and the lowest overall water cut.

In some implementations, the data processing system determines well paths for multiple wells, the multiple wells having different well paths based on the lowest value of the vertical permeability between the FWC/OWL and a completion section of the respective well. The data processing system can determine a hydrocarbon production potential and a water cut for each of the multiple wells with different paths. The data processing system can select the well path associated with the highest hydrocarbon production potential and the lowest water cut.

The data processing system can implement a maximum deviation constraint while determining the well path of the wellbore and/or sidetrack of an existing well. For example, the data processing system can constrain the well path to have a maximum deviation of 3 degree/100 ft (3 degree/30 meters). The data processing system can also implement the minimum distance between neighboring wells constraint while determining the well path. When one or more of the constraints are violated, the data processing system generates a new well path until all of the constraints are satisfied.

The data processing system drills the well at the identified location based on the determined well path (step 212). For example, the data processing system generates control commands to control drilling equipment to drill the well based on the determined well path. The data processing system can, for example, control the direction of the drill (e.g., geo-steering), control the rate of penetration of the drill, the rotations per minute of the drill, the weight on the drill bit, etc.

The well path can include vertical and/or non-vertical segments. Non-vertical (e.g., slanted, or horizontal) wells or well segments can be used to increase the exposure of the well to a reservoir. Non-vertical wells can be used to access reservoirs where vertical access is difficult or not possible. A well path that includes non-vertical segments can indicate a depth for the non-vertical segment to begin, an inclination of the non-vertical segment, and an azimuth of the non-vertical segment. Directional drilling is a technique to drill non-vertical segments of a well.

Figure 3:
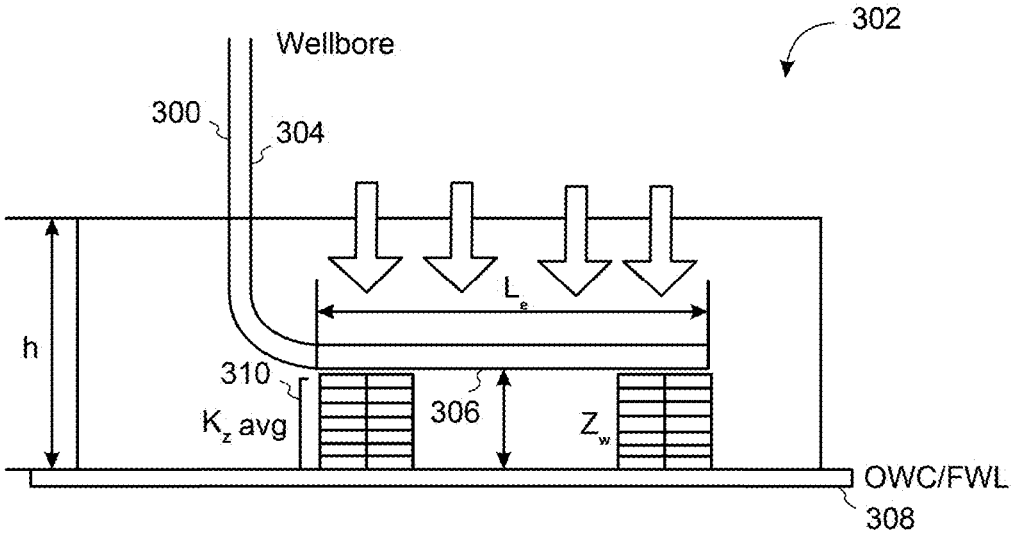
FIG. 3 is a schematic illustrating a horizontal well in a subsurface formation.

FIG. 3 is a schematic illustrating a well 300 in a subsurface formation 302. The well 300 includes a vertical portion 304 and a horizontal portion 306. The horizontal portion 306 is parallel to the FWL/OWC 308. A low average permeability 310 between the FWL/OWC 308 and the horizontal portion 306 increases the flow impedance of water flowing from the FWL/OWC 308 to the horizontal portion 306 thereby reducing water produced through the well 300.

Figure 4:
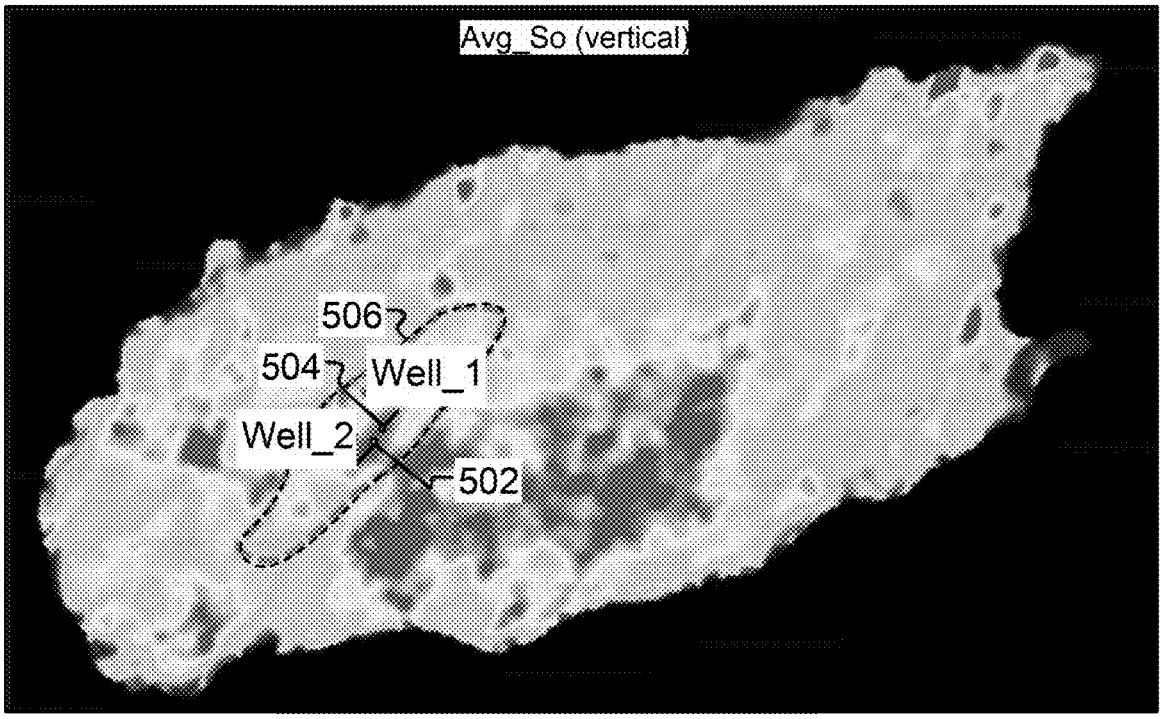
FIG. 4 is a visualization of average oil saturation in a subsurface formation.

FIG. 4 is a visualization 500 of average oil saturation, $S_o$, in a subsurface formation. Two wells 502, 504 are placed within an AOI 506. Well 502 is placed in a location with a higher $S_o$ than well 504. Intuitively, based on the oil saturation alone, well 502 should produce more oil and less water than well 504 because it is placed in a more saturated location.

Figure 5:
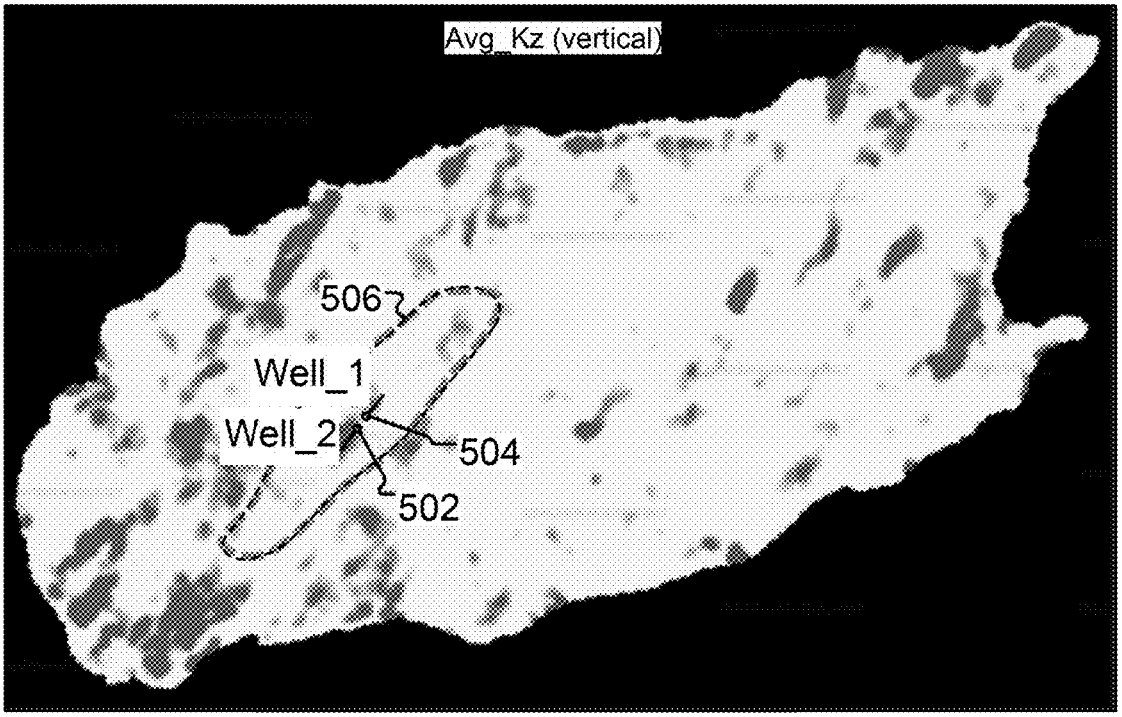
FIG. 5 is a visualization of average vertical permeability in a subsurface formation.

FIG. 5 is a visualization 600 of average vertical permeability in the subsurface formation shown in FIG. 4. Although well 502 is placed in a more saturated location, the vertical permeability between the FWL/OWC and the well 502 is higher at than the average vertical permeability for well 504. Counterintuitively, well 504 produces more oil with less water cut than well 502 because the low average vertical permeability for well 504 inhibits the flow of water to the well 504.

Figure 6:
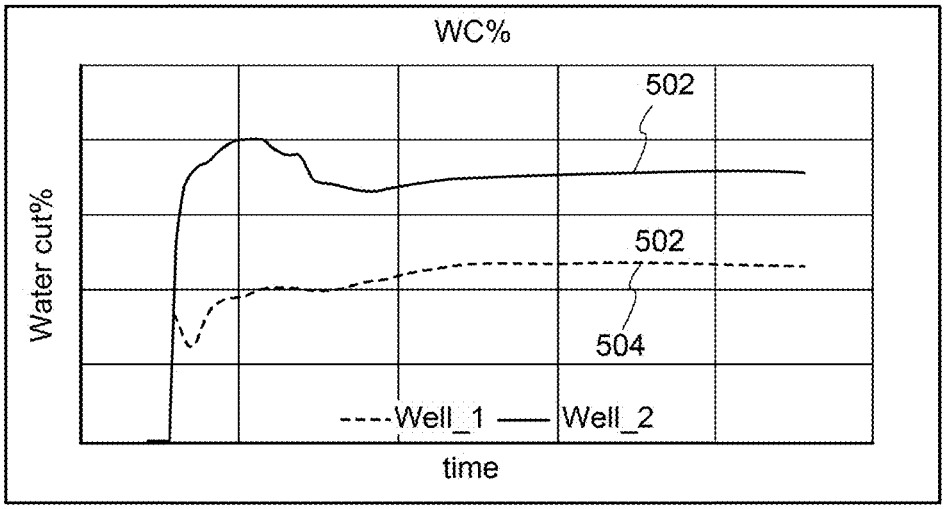
FIGS. 6-8 are plots showing water cut percentage, oil rate, and cumulative oil production from two wells.
Figure 7:
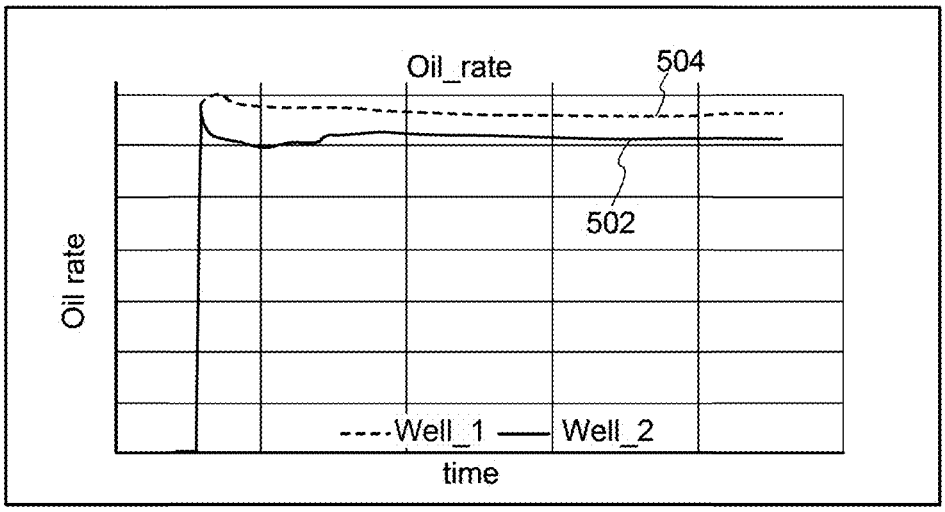
Figure 8:
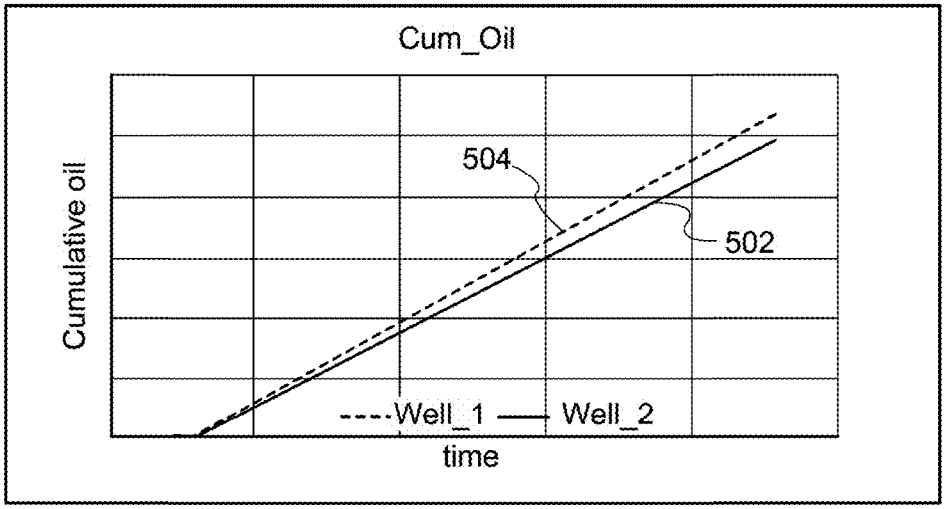

FIGS. 6-8 are plots showing water cut percentage, oil rate, and cumulative oil production from the wells 502, 504 shown in FIGS. 4-5. As discussed above, the well 504 has a lower water cut percentage, a higher oil rate, and a higher cumulative oil production than well 504.

Figure 9:
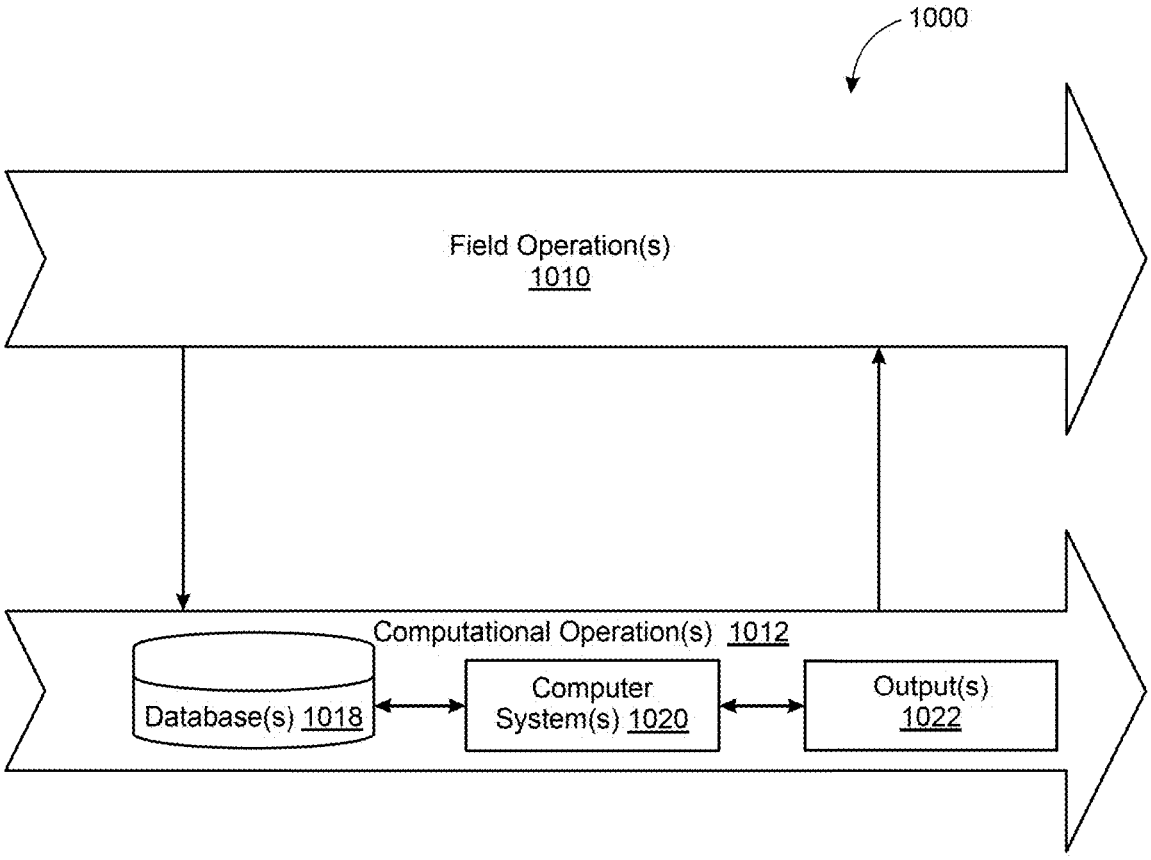
FIG. 9 illustrates hydrocarbon production operations that include field operations and computational operations, according to some implementations.

FIG. 9 illustrates hydrocarbon production operations 1000 that include both one or more field operations 1010 and one or more computational operations 1012, which exchange information and control exploration for the production of hydrocarbons. In some implementations, outputs of techniques of the present disclosure (e.g., the method 200) can be performed before, during, or in combination with the hydrocarbon production operations 1000, specifically, for example, either as field operations 1010 or computational operations 1012, or both.

Examples of field operations 1010 include forming/drilling a wellbore, hydraulic fracturing, producing through the wellbore, injecting fluids (such as water) through the wellbore, to name a few. In some implementations, methods of the present disclosure can trigger or control the field operations 1010. For example, the methods of the present disclosure can generate data from hardware/software including sensors and physical data gathering equipment (e.g., seismic sensors, well logging tools, flow meters, and temperature and pressure sensors). The methods of the present disclosure can include transmitting the data from the hardware/software to the field operations 1010 and responsively triggering the field operations 1010 including, for example, generating plans and signals that provide feedback to and control physical components of the field operations 1010. Alternatively, or in addition, the field operations 1010 can trigger the methods of the present disclosure. For example, implementing physical components (including, for example, hardware, such as sensors) deployed in the field operations 1010 can generate plans and signals that can be provided as input or feedback (or both) to the methods of the present disclosure.

Examples of computational operations 1012 include one or more computer systems 1020 that include one or more processors and computer-readable media (e.g., non-transitory computer-readable media) operatively coupled to the one or more processors to execute computer operations to perform the methods of the present disclosure. The computational operations 1012 can be implemented using one or more databases 1018, which store data received from the field operations 1010 and/or generated internally within the computational operations 1012 (e.g., by implementing the methods of the present disclosure) or both. For example, the one or more computer systems 1020 process inputs from the field operations 1010 to assess conditions in the physical world, the outputs of which are stored in the databases 1018. For example, seismic sensors of the field operations 1010 can be used to perform a seismic survey to map subterranean features, such as facies and faults. In performing a seismic survey, seismic sources (e.g., seismic vibrators or explosions) generate seismic waves that propagate in the earth and seismic receivers (e.g., geophones) measure reflections generated as the seismic waves interact with boundaries between layers of a subsurface formation. The source and received signals are provided to the computational operations 1012 where they are stored in the databases 1018 and analyzed by the one or more computer systems 1020.

In some implementations, one or more outputs 1022 generated by the one or more computer systems 1020 can be provided as feedback/input to the field operations 1010 (either as direct input or stored in the databases 1018). The field operations 1010 can use the feedback/input to control physical components used to perform the field operations 1010 in the real world.

For example, the computational operations 1012 can process the seismic data to generate three-dimensional (3D) maps of the subsurface formation. The computational operations 1012 can use these 3D maps to provide plans for locating and drilling exploratory wells. In some operations, the exploratory wells are drilled using logging-while-drilling (LWD) techniques which incorporate logging tools into the drill string. LWD techniques can enable the computational operations 1012 to process new information about the formation and control the drilling to adjust to the observed conditions in real-time.

The one or more computer systems 1020 can update the 3D maps of the subsurface formation as information from one exploration well is received and the computational operations 1012 can adjust the location of the next exploration well based on the updated 3D maps. Similarly, the data received from production operations can be used by the computational operations 1012 to control components of the production operations. For example, production well and pipeline data can be analyzed to predict slugging in pipelines leading to a refinery and the computational operations 1012 can control machine operated valves upstream of the refinery to reduce the likelihood of plant disruptions that run the risk of taking the plant offline.

In some implementations of the computational operations 1012, customized user interfaces can present intermediate or final results of the above-described processes to a user. Information can be presented in one or more textual, tabular, or graphical formats, such as through a dashboard. The information can be presented at one or more on-site locations (such as at an oil well or other facility), on the Internet (such as on a webpage), on a mobile application (or app), or at a central processing facility.

The presented information can include feedback, such as changes in parameters or processing inputs, that the user can select to improve a production environment, such as in the exploration, production, and/or testing of petrochemical processes or facilities. For example, the feedback can include parameters that, when selected by the user, can cause a change to, or an improvement in, drilling parameters (including drill bit speed and direction) or overall production of a gas or oil well. The feedback, when implemented by the user, can improve the speed and accuracy of calculations, streamline processes, improve models, and solve problems related to efficiency, performance, safety, reliability, costs, downtime, and the need for human interaction.

In some implementations, the feedback can be implemented in real-time, such as to provide an immediate or near-immediate change in operations or in a model. The term real-time (or similar terms as understood by one of ordinary skill in the art) means that an action and a response are temporally proximate such that an individual perceives the action and the response occurring substantially simultaneously. For example, the time difference for a response to display (or for an initiation of a display) of data following the individual's action to access the data can be less than 1 millisecond (ms), less than 1 second(s), or less than 5 s. While the requested data need not be displayed (or initiated for display) instantaneously, it is displayed (or initiated for display) without any intentional delay, taking into account processing limitations of a described computing system and time required to, for example, gather, accurately measure, analyze, process, store, or transmit the data.

Events can include readings or measurements captured by downhole equipment such as sensors, pumps, bottom hole assemblies, or other equipment. The readings or measurements can be analyzed at the surface, such as by using applications that can include modeling applications and machine learning. The analysis can be used to generate changes to settings of downhole equipment, such as drilling equipment. In some implementations, values of parameters or other variables that are determined can be used automatically (such as through using rules) to implement changes in oil or gas well exploration, production/drilling, or testing. For example, outputs of the present disclosure can be used as inputs to other equipment and/or systems at a facility. This can be especially useful for systems or various pieces of equipment that are located several meters or several miles apart or are located in different countries or other jurisdictions.

Figure 10:
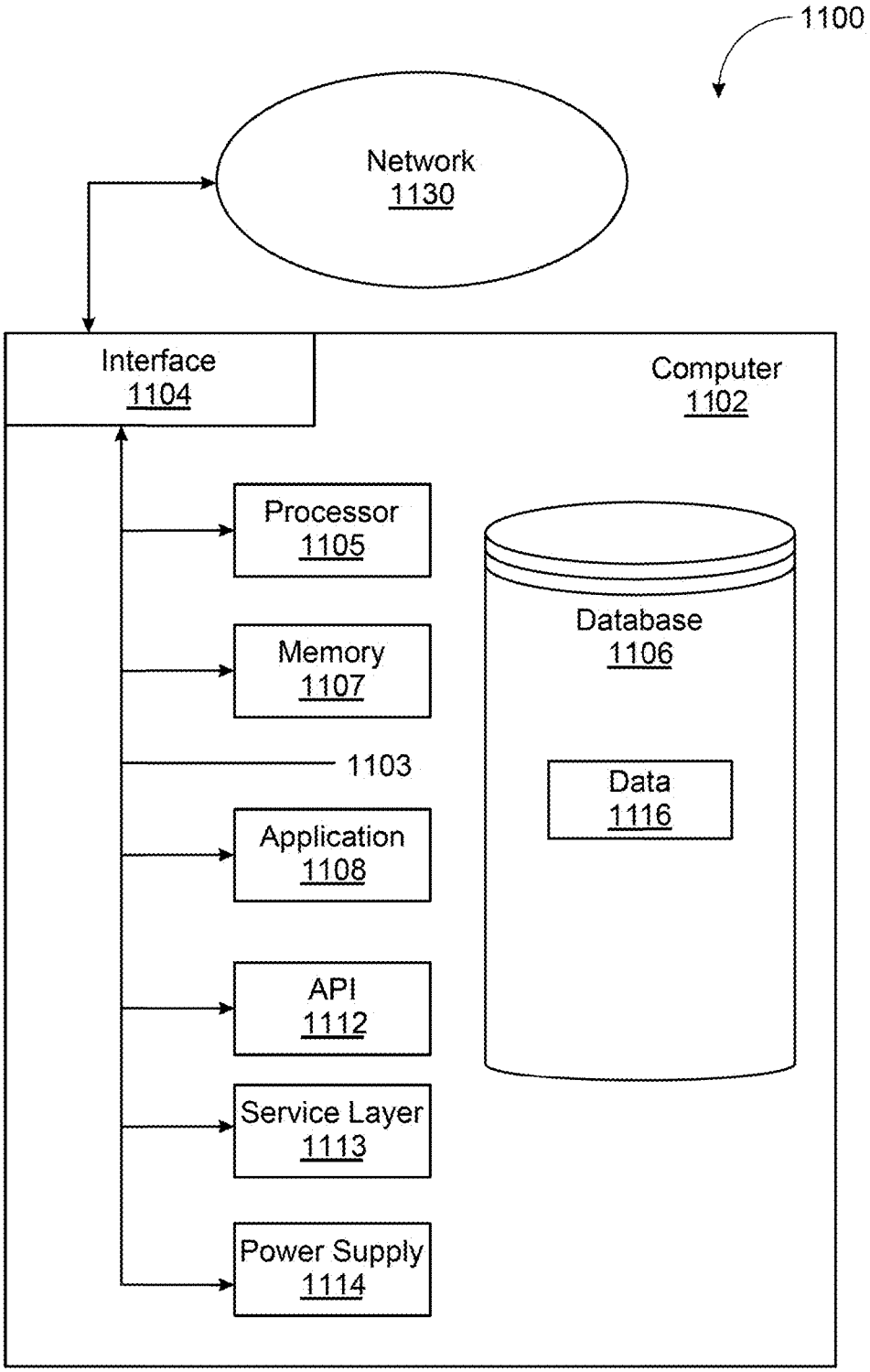
FIG. 10 is a block diagram illustrating an example computer system used to provide computational functionalities associated with described algorithms, methods, functions, processes, flows, and procedures according to some implementations of the present disclosure.

FIG. 10 is a block diagram of an example computer system 1100 used to provide computational functionalities associated with described algorithms, methods, functions, processes, flows, and procedures described in the present disclosure, according to some implementations of the present disclosure. The illustrated computer 1102 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 1102 can include input devices such as keypads, keyboards, and touch screens that can accept user information. Also, the computer 1102 can include output devices that can convey information associated with the operation of the computer 1102. The information can include digital data, visual data, audio information, or a combination of information. The information can be presented in a graphical user interface (UI) (or GUI).

The computer 1102 can serve in a role as a client, a network component, a server, a database, a persistency, or components of a computer system for performing the subject matter described in the present disclosure. The illustrated computer 1102 is communicably coupled with a network 1130. In some implementations, one or more components of the computer 1102 can be configured to operate within different environments, including cloud-computing-based environments, local environments, global environments, and combinations of environments.

At a high level, the computer 1102 is an electronic computing device operable to receive, transmit, process, store, and manage data and information associated with the described subject matter. According to some implementations, the computer 1102 can also include, or be communicably coupled with, an application server, an email server, a web server, a caching server, a streaming data server, or a combination of servers.

The computer 1102 can receive requests over network 1130 from a client application (for example, executing on another computer 1102). The computer 1102 can respond to the received requests by processing the received requests using software applications. Requests can also be sent to the computer 1102 from internal users (for example, from a command console), external (or third) parties, automated applications, entities, individuals, systems, and computers.

Each of the components of the computer 1102 can communicate using a system bus 1103. In some implementations, any or all of the components of the computer 1102, including hardware or software components, can interface with each other or the interface 1104 (or a combination of both), over the system bus 1103. Interfaces can use an application programming interface (API) 1112, a service layer 1113, or a combination of the API 1112 and service layer 1113. The API 1112 can include specifications for routines, data structures, and object classes. The API 1112 can be either computer-language independent or dependent. The API 1112 can refer to a complete interface, a single function, or a set of APIs.

The service layer 1113 can provide software services to the computer 1102 and other components (whether illustrated or not) that are communicably coupled to the computer 1102. The functionality of the computer 1102 can be accessible for all service consumers using this service layer. Software services, such as those provided by the service layer 1113, can provide reusable, defined functionalities through a defined interface. For example, the interface can be software written in JAVA, C++, or a language providing data in extensible markup language (XML) format. While illustrated as an integrated component of the computer 1102, in alternative implementations, the API 1112 or the service layer 1113 can be stand-alone components in relation to other components of the computer 1102 and other components communicably coupled to the computer 1102. Moreover, any or all parts of the API 1112 or the service layer 1113 can be implemented as child or sub-modules of another software module, enterprise application, or hardware module without departing from the scope of the present disclosure.

The computer 1102 includes an interface 1104. Although illustrated as a single interface 1104 in FIG. 10, two or more interfaces 1104 can be used according to particular needs, desires, or particular implementations of the computer 1102 and the described functionality. The interface 1104 can be used by the computer 1102 for communicating with other systems that are connected to the network 1130 (whether illustrated or not) in a distributed environment. Generally, the interface 1104 can include, or be implemented using, logic encoded in software or hardware (or a combination of software and hardware) operable to communicate with the network 1130. More specifically, the interface 1104 can include software supporting one or more communication protocols associated with communications. As such, the network 1130 or the interface's hardware can be operable to communicate physical signals within and outside of the illustrated computer 1102.

The computer 1102 includes a processor 1105. Although illustrated as a single processor 1105 in FIG. 10, two or more processors 1105 can be used according to particular needs, desires, or particular implementations of the computer 1102 and the described functionality. Generally, the processor 1105 can execute instructions and can manipulate data to perform the operations of the computer 1102, including operations using algorithms, methods, functions, processes, flows, and procedures as described in the present disclosure.

The computer 1102 also includes a database 1106 that can hold data for the computer 1102 and other components connected to the network 1130 (whether illustrated or not). For example, database 1106 can hold data 1116 (e.g., resistivity data). For example, database 1106 can be an in-memory, conventional, or a database storing data consistent with the present disclosure. In some implementations, database 1106 can be a combination of two or more different database types (for example, hybrid in-memory and conventional databases) according to particular needs, desires, or particular implementations of the computer 1102 and the described functionality. Although illustrated as a single database 1106 in FIG. 10, two or more databases (of the same, different, or combination of types) can be used according to particular needs, desires, or particular implementations of the computer 1102 and the described functionality. While database 1106 is illustrated as an internal component of the computer 1102, in alternative implementations, database 1106 can be external to the computer 1102.

The computer 1102 also includes a memory 1107 that can hold data for the computer 1102 or a combination of components connected to the network 1130 (whether illustrated or not). Memory 1107 can store any data consistent with the present disclosure. In some implementations, memory 1107 can be a combination of two or more different types of memory (for example, a combination of semiconductor and magnetic storage) according to particular needs, desires, or particular implementations of the computer 1102 and the described functionality. Although illustrated as a single memory 1107 in FIG. 10, two or more memories 1107 (of the same, different, or combination of types) can be used according to particular needs, desires, or particular implementations of the computer 1102 and the described functionality. While memory 1107 is illustrated as an internal component of the computer 1102, in alternative implementations, memory 1107 can be external to the computer 1102.

The application 1108 can be an algorithmic software engine providing functionality according to particular needs, desires, or particular implementations of the computer 1102 and the described functionality. For example, application 1108 can serve as one or more components, modules, or applications. Further, although illustrated as a single application 1108, the application 1108 can be implemented as multiple applications 1108 on the computer 1102. In addition, although illustrated as internal to the computer 1102, in alternative implementations, the application 1108 can be external to the computer 1102.

The computer 1102 can also include a power supply 1114. The power supply 1114 can include a rechargeable or non-rechargeable battery that can be configured to be either user- or non-user-replaceable. In some implementations, the power supply 1114 can include power-conversion and management circuits, including recharging, standby, and power management functionalities. In some implementations, the power-supply 1114 can include a power plug to allow the computer 1102 to be plugged into a wall socket or a power source to, for example, power the computer 1102 or recharge a rechargeable battery.

There can be any number of computers 1102 associated with, or external to, a computer system containing computer 1102, with each computer 1102 communicating over network 1130. Further, the terms "client," "user," and other appropriate terminology can be used interchangeably, as appropriate, without departing from the scope of the present disclosure. Moreover, the present disclosure contemplates that many users can use one computer 1102 and one user can use multiple computers 1102.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non transitory, computer-readable computer-storage medium for execution by, or to control the operation of, data processing apparatus. Alternatively, or additionally, the program instructions can be encoded in/on an artificially generated propagated signal. The example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example LINUX, UNIX, WINDOWS, MAC OS, ANDROID, or IOS.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computer readable media (transitory or non-transitory, as appropriate) suitable for storing computer program instructions and data can include all forms of permanent/non-permanent and volatile/non-volatile memory, media, and memory devices. Computer readable media can include, for example, semiconductor memory devices such as random access memory (RAM), read only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

A number of implementations of these systems and methods have been described. Nevertheless, it will be understood that various modifications may be made without departing from the spirit and scope of this disclosure. Accordingly, other implementations are within the scope of the following claims.

EXAMPLES

In an example implementation, a method for placing a well in a subsurface formation includes obtaining reservoir properties from the subsurface formation; determining an area of interest based on the reservoir properties and a free water level or an oil-water contact in the subsurface formation; determining sweet spot areas in the area of interest based on the reservoir properties; identifying a location to place a well in the subsurface formation by performing a clustering analysis based on the sweet spot areas; and determining a well path for the well based on the reservoir properties and the free water level or the oil-water contact.

An aspect combinable with the example implementation includes drilling the well at the identified location based on the determined well path.

In an aspect combinable with the example implementation, the reservoir properties include oil saturation, rock porosity, and vertical permeability.

In another aspect combinable with one, some, or all of the previous aspects, determining the sweet spot areas is based on the oil saturation and the rock porosity.

In another aspect combinable with one, some, or all of the previous aspects, determining the well path includes generating multiple well paths based on a lowest value of the vertical permeability between the free water level or the oil-water contact and a completion section of a well; determining a hydrocarbon production potential and a water cut for well paths of the multiple well paths; and selecting the well path from the multiple well paths, the well path being associated with the highest hydrocarbon production potential and the lowest water cut.

In another aspect combinable with one, some, or all of the previous aspects, performing the clustering analysis includes applying a density-based clustering method to generate clusters including a high density of the sweet spot areas separated by regions including a low density of the sweet spot areas; and identifying the location to place the well includes selecting a cluster including the sweet spot areas including a largest hydrocarbon volume as compared to the sweet spot areas in other clusters.

In another aspect combinable with one, some, or all of the previous aspects, identifying the location to place the well includes specifying a minimum distance between the well and other wells in the subsurface formation.

In another aspect combinable with one, some, or all of the previous aspects, determining a well path comprises establishing a maximum deviation for the well path.

In another example implementation, a system for placing a well in a subsurface formation includes one or more processors; and a memory storing instructions for placing a well in the subsurface formation, the instructions, when executed by the one or more processors, cause the one or more processors to perform operations including obtaining reservoir properties from the subsurface formation; determining an area of interest based on the reservoir properties and a free water level or an oil-water contact in the subsurface formation; determining sweet spot areas in the area of interest based on the reservoir properties; identifying a location to place a well in the subsurface formation by performing a clustering analysis based on the sweet spot areas; determining a well path for the well based on the reservoir properties and the free water level or the oil-water contact.

In an aspect combinable with the example implementation, the instructions further include drilling the well at the identified location based on the determined well path.

In another aspect combinable with one, some, or all of the previous aspects, the reservoir properties include oil saturation, rock porosity, and vertical permeability.

In another aspect combinable with one, some, or all of the previous aspects, determining the sweet spot areas is based on the oil saturation and the rock porosity.

In another aspect combinable with one, some, or all of the previous aspects, determining the well path includes generating multiple well paths based on a lowest value of the vertical permeability between the free water level or the oil-water contact and a completion section of a well; determining a hydrocarbon production potential and a water cut for well paths of the multiple well paths; and selecting the well path from the multiple well paths, the well path being associated with the highest hydrocarbon production potential and the lowest water cut.

In another aspect combinable with one, some, or all of the previous aspects, performing the clustering analysis includes applying a density-based clustering method to generate clusters including a high density of the sweet spot areas separated by regions including a low density of the sweet spot areas; and wherein identifying the location to place the well includes selecting a cluster including the sweet spot areas including a largest hydrocarbon volume as compared to the sweet spot areas in other clusters.

In another aspect combinable with one, some, or all of the previous aspects, identifying the location to place the well includes specifying a minimum distance between the well and other wells in the subsurface formation.

In another aspect combinable with one, some, or all of the previous aspects, determining a well path includes establishing a maximum deviation for the well path.

In another example implementation, one or more non-transitory machine-readable storage devices storing instructions for placing a well in a subsurface formation, the instructions being executable by one or more processors, to cause performance of operations including obtaining reservoir properties from the subsurface formation; determining an area of interest based on the reservoir properties and a free water level or an oil-water contact in the subsurface formation; determining sweet spot areas in the area of interest based on the reservoir properties; identifying a location to place a well in the subsurface formation by performing a clustering analysis based on the sweet spot areas; and determining a well path for the well based on the reservoir properties and the free water level or the oil-water contact.

In an aspect combinable with the example implementation, the instructions further include drilling the well at the identified location based on the determined well path.

In another aspect combinable with one, some, or all of the previous aspects, the reservoir properties include oil saturation, rock porosity, and vertical permeability.

In another aspect combinable with one, some, or all of the previous aspects, determining the well path includes generating multiple well paths based on a lowest value of the vertical permeability between the free water level or the oil-water contact and a completion section of a well; determining a hydrocarbon production potential and a water cut for well paths of the multiple well paths; and selecting the well path from the multiple well paths, the well path being associated with the highest hydrocarbon production potential and the lowest water cut.

In another aspect combinable with one, some, or all of the previous aspects, performing the clustering analysis includes applying a density-based clustering method to generate clusters including a high density of the sweet spot areas separated by regions including a low density of the sweet spot areas; and identifying the location to place the well includes selecting a cluster including the sweet spot areas including a largest hydrocarbon volume as compared to the sweet spot areas in other clusters.

In another aspect combinable with one, some, or all of the previous aspects, identifying the location to place the well includes specifying a minimum distance between the well and other wells in the subsurface formation.

In another aspect combinable with one, some, or all of the previous aspects, determining a well path includes establishing a maximum deviation for the well path.

What is claimed is:

1. A method for placing a well in a subsurface formation, the method comprising:

obtaining reservoir properties from the subsurface formation;

determining an area of interest based on the reservoir properties and a free water level or an oil-water contact in the subsurface formation;

determining sweet spot areas in the area of interest based on the reservoir properties;

identifying a location to place a well in the subsurface formation by performing a clustering analysis based on the sweet spot areas; and determining a well path for the well based on a value of vertical permeability between the free water level or the oil-water contact and a completion section of the well; and drilling the well at the identified location based on the determined well path.

2. The method of claim 1, wherein the reservoir properties comprise oil saturation, rock porosity, and vertical permeability, and wherein determining the sweet spot areas is based on the oil saturation and the rock porosity.

3. The method of claim 2, wherein determining the well path comprises:

generating multiple wells with different well paths based on a lowest value of the vertical permeability between the free water level or the oil-water contact and the completion section of the well;

determining a hydrocarbon production potential and a water cut for the multiple wells; and selecting the well path from the multiple wells with different paths, the well path being associated with a highest hydrocarbon production potential and a lowest water cut.

4. The method of claim 1, wherein performing the clustering analysis comprises applying a density-based clustering method to generate clusters comprising a high density of the sweet spot areas separated by regions comprising a low density of the sweet spot areas; and wherein identifying the location to place the well comprises selecting a cluster comprising the sweet spot areas comprising a largest hydrocarbon volume as compared to the sweet spot areas in other clusters.

5. The method of claim 4, wherein identifying the location to place the well comprises specifying a minimum distance between the well and other wells in the subsurface formation.

6. The method of claim 1, wherein determining the well path comprises establishing a maximum deviation for the well path.

7. A system for placing a well in a subsurface formation, the system comprising:

one or more processors; and a memory storing instructions for simulating a physical process, the instructions, when executed by the one or more processors, cause the one or more processors to perform operations comprising:

obtaining reservoir properties from the subsurface formation;

determining an area of interest based on the reservoir properties and a free water level or an oil-water contact in the subsurface formation;

determining sweet spot areas in the area of interest based on the reservoir properties;

identifying a location to place a well in the subsurface formation by performing a clustering analysis based on the sweet spot areas; and determining a well path for the well based on a value of vertical permeability between the free water level or the oil-water contact and a completion section of the well; and drilling the well at the identified location based on the determined well path.

8. The system of claim 7, wherein the reservoir properties comprise oil saturation, rock porosity, and vertical permeability, and wherein determining the sweet spot areas is based on the oil saturation and the rock porosity.

9. The system of claim 8, wherein determining the well path comprises:

generating multiple wells with different well paths based on a lowest value of the vertical permeability between the free water level or the oil-water contact and the completion section of the well;

determining a hydrocarbon production potential and a water cut for the multiple wells; and selecting the well path from the multiple wells with different paths, the well path being associated with a highest hydrocarbon production potential and a lowest water cut.

10. The system of claim 7, wherein performing the clustering analysis comprises applying a density-based clustering method to generate clusters comprising a high density of the sweet spot areas separated by regions comprising a low density of the sweet spot areas; and wherein identifying the location to place the well comprises selecting a cluster comprising the sweet spot areas comprising a largest hydrocarbon volume as compared to the sweet spot areas in other clusters.

11. The system of claim 10, wherein identifying the location to place the well comprises specifying a minimum distance between the well and other wells in the subsurface formation.

12. The system of claim 7, wherein determining the well path comprises establishing a maximum deviation for the well path.

13. One or more non-transitory machine-readable storage devices storing instructions for placing a well in a subsurface formation, the instructions being executable by one or more processors, to cause performance of operations comprising:

obtaining reservoir properties from the subsurface formation;

determining an area of interest based on the reservoir properties and a free water level or an oil-water contact in the subsurface formation;

determining sweet spot areas in the area of interest based on the reservoir properties;

identifying a location to place a well in the subsurface formation by performing a clustering analysis based on the sweet spot areas; and determining a well path for the well based on a value of vertical permeability between the free water level or the oil-water contact and a completion section of the well; and drilling the well at the identified location based on the determined well path.

14. The one or more non-transitory machine-readable storage devices of claim 13, wherein the reservoir properties comprise oil saturation, rock porosity, and vertical permeability.

15. The one or more non-transitory machine-readable storage devices of claim 14, wherein determining the well path comprises:

generating multiple wells with different well paths based on a lowest value of the vertical permeability between the free water level or the oil-water contact and the completion section of the well;

determining a hydrocarbon production potential and a water cut for the multiple wells; and selecting the well path from the multiple wells with different paths, the well path being associated with a highest hydrocarbon production potential and a lowest water cut.

16. The one or more non-transitory machine-readable storage devices of claim 13, wherein performing the clustering analysis comprises applying a density-based clustering method to generate clusters comprising a high density of the sweet spot areas separated by regions comprising a low density of the sweet spot areas; and wherein identifying the location to place the well comprises selecting a cluster comprising the sweet spot areas comprising a largest hydrocarbon volume as compared to the sweet spot areas in other clusters.

17. The one or more non-transitory machine-readable storage devices of claim 16, wherein identifying the location to place the well comprises specifying a minimum distance between the well and other wells in the subsurface formation.

* * * * *